US011454380B2

(12) United States Patent
Zhou et al.

(10) Patent No.: US 11,454,380 B2
(45) Date of Patent: Sep. 27, 2022

(54) READING LAMP

(71) Applicant: eMoMo Technology Co., Ltd., Baoan (CN)

(72) Inventors: Wei Zhou, Wuhan (CN); Jingzhi Chen, Shenzhen (CN); Wenji Tang, Shenzhen (CN); Dasheng Hu, Qingtang Town (CN); Qishuang Lu, Dengzhou (CN); Shunde Yang, Suizhou (CN)

(73) Assignee: eMoMo Technology Co., Ltd., Baoan (CN)

( * ) Notice: Subject to any disclaimer, the term of this patent is extended or adjusted under 35 U.S.C. 154(b) by 126 days.

(21) Appl. No.: 17/039,249

(22) Filed: Sep. 30, 2020

(65) Prior Publication Data

US 2021/0140611 A1 May 13, 2021

(30) Foreign Application Priority Data

Nov. 7, 2019 (CN) ..... 201911078992.9

(51) Int. Cl.

| | |
|---|---|
| ***F21V 19/02*** | (2006.01) |
| ***F21S 8/08*** | (2006.01) |
| ***F21V 23/00*** | (2015.01) |
| ***F21V 23/04*** | (2006.01) |

(52) U.S. Cl.

CPC ..... *F21V 19/02* (2013.01); *F21S 8/08* (2013.01); *F21V 23/003* (2013.01); *F21V 23/0485* (2013.01)

(58) Field of Classification Search

CPC .... F21V 19/02; F21V 23/003; F21V 23/0485; F21S 8/08

See application file for complete search history.

(56) References Cited

U.S. PATENT DOCUMENTS

| | | | |
|---|---|---|---|
| 4,258,287 | A | 3/1981 | Hetzel |
| D352,127 | S | 11/1994 | Young |
| D397,472 | S | 8/1998 | Lecluze |
| D423,130 | S | 4/2000 | Kung |
| D442,311 | S | 5/2001 | Kao et al. |
| D473,966 | S | 4/2003 | Lecluze |
| 6,780,049 | B1 | 8/2004 | D'Angelo et al. |

(Continued)

FOREIGN PATENT DOCUMENTS

| | | |
|---|---|---|
| CN | 305718207 | 4/2020 |
| EP | 066221710001 | 7/2019 |

OTHER PUBLICATIONS

United States Patent and Trademark Office; Non-Final Office Action for U.S. Appl. No. 16/999,319 dated Jan. 18, 2022; 6 pages.

(Continued)

*Primary Examiner* — Thomas M Sember

(74) *Attorney, Agent, or Firm* — Moyles IP, LLC

(57) ABSTRACT

A reading lamp includes a lamp top set having a tubular housing and a support column having a first end and a second end opposite the first end. The support column may include a column wall defining a hollow interior of the support column. A swiveling joint assembly may be positioned between and join the tubular housing and the first end of the support column, such that the swiveling joint assembly enables one or more of polyaxial and rotational movement of the tubular housing relative to the support column or the swiveling joint assembly.

19 Claims, 6 Drawing Sheets

(56) References Cited

U.S. PATENT DOCUMENTS

| | | | |
|---|---|---|---|
| D542,955 | S | 5/2007 | Hodgson |
| D543,307 | S | 5/2007 | Bynum et al. |
| 7,393,229 | B2 | 7/2008 | Yoshida et al. |
| D575,895 | S | 8/2008 | Poel |
| D578,299 | S | 10/2008 | Dennis |
| D581,089 | S | 11/2008 | St-Hilaire |
| D581,576 | S | 11/2008 | Montalbano et al. |
| 7,578,693 | B2 | 8/2009 | Yoshida et al. |
| D624,689 | S | 9/2010 | Kao |
| D625,031 | S | 10/2010 | Yamamoto et al. |
| 7,850,620 | B2 | 12/2010 | Miller et al. |
| D637,332 | S | 5/2011 | Lee |
| D641,903 | S | 7/2011 | Nam |
| 8,002,587 | B2 | 8/2011 | Fleisig |
| D662,639 | S | 6/2012 | Ng et al. |
| 8,193,658 | B2 | 6/2012 | Fleisig |
| D685,507 | S | 7/2013 | Sun |
| D697,650 | S | 1/2014 | Maxik et al. |
| D726,951 | S | 4/2015 | Serwacki et al. |
| D729,964 | S | 5/2015 | Huh |
| D743,594 | S | 11/2015 | Scazziga |
| D743,614 | S | 11/2015 | Ng |
| 9,352,660 | B2 | 5/2016 | Osawa |
| D761,453 | S | 7/2016 | Sorokin |
| D773,097 | S | 11/2016 | Zhao et al. |
| 9,719,641 | B1 * | 8/2017 | Volek ..... F21V 23/02 |
| D804,704 | S | 12/2017 | Xia et al. |
| D815,326 | S | 4/2018 | Waldmann |
| D822,856 | S | 7/2018 | Liao et al. |
| 10,122,140 | B1 | 11/2018 | Vega-Perez |
| 10,128,622 | B1 | 11/2018 | Clark et al. |
| 10,128,645 | B2 | 11/2018 | Delmas et al. |
| D847,403 | S | 4/2019 | Baker |
| 10,276,949 | B2 | 4/2019 | Lee et al. |
| D855,230 | S | 7/2019 | Zhang |
| 10,374,353 | B2 | 8/2019 | Archuleta et al. |
| D859,732 | S | 9/2019 | Robinson |
| 10,418,768 | B1 | 9/2019 | Xiao |
| 10,424,866 | B1 | 9/2019 | Peng et al. |
| 10,435,175 | B2 | 10/2019 | Sure et al. |
| D867,625 | S | 11/2019 | Khubani |
| D885,627 | S | 5/2020 | Ludwig |
| D893,789 | S | 8/2020 | Ng et al. |
| 10,886,679 | B1 | 1/2021 | Hurtado |
| 10,900,640 | B2 | 1/2021 | Xia et al. |
| D912,292 | S | 3/2021 | Hodgson |
| D923,222 | S | 6/2021 | Le et al. |
| D937,779 | S | 12/2021 | Tang |
| D944,781 | S | 3/2022 | Cran et al. |
| 2002/0163812 | A1 | 11/2002 | Tseng |
| 2006/0146553 | A1 | 7/2006 | Zeng et al. |
| 2009/0161340 | A1 | 6/2009 | Huang et al. |
| 2009/0190348 | A1 | 7/2009 | Lin |
| 2010/0226023 | A1 | 9/2010 | Lee |
| 2011/0182063 | A1 | 7/2011 | Hsieh |
| 2012/0087142 | A1 | 4/2012 | Schultheis et al. |
| 2013/0286652 | A1 | 10/2013 | Chiu |
| 2014/0022782 | A1 | 1/2014 | Tessnow et al. |
| 2015/0216331 | A1 | 8/2015 | Sanchez |
| 2016/0047494 | A1 | 2/2016 | Dickinson et al. |
| 2016/0356466 | A1 | 12/2016 | Recor et al. |
| 2017/0272624 | A1 | 9/2017 | Minikey, Jr. et al. |
| 2018/0213627 | A1 | 7/2018 | Xia et al. |
| 2021/0116100 | A1 | 4/2021 | Deng et al. |
| 2021/0140617 | A1 | 5/2021 | Tang et al. |
| 2021/0239282 | A1 | 8/2021 | Burt et al. |
| 2021/0239287 | A1 | 8/2021 | Gallaga et al. |
| 2021/0254817 | A1 | 8/2021 | Dyson et al. |

OTHER PUBLICATIONS

EMoMo E/32, No date available, [online], [site visited Sep. 1, 2021]. Available from Internet, URL: http://www.emomotech.com/en/product/51033257.html (Year: NA) (Year NA).

United States Patent and Trademark Office; Notice of Allowance for U.S. Appl. No. 29/700,673; dated Sep. 15, 2021; 5 pages.

United States Patent and Trademark Office; Non-Final Office Action for U.S. Appl. No. 29/700,673; dated Dec. 24, 2020; 11 pages.

Alvin Torfino LED Lamp, May 5, 2017, Amazon.com, site visited Apr. 27, 2022, url: https://www.amazon.com/dp/B071DXLMM5Year: 2017) 3 pages.

Asdsda LED Full Metal Table Lamp, Apr. 26, 2019, Amazon.com, site visited Apr. 27, 2022, url: https://www.amazon.com/dp/BO7R7CJB64/ (Year: 2019) 3 pages.

MarsLG Folding LED Desk Lamp, Apr. 11, 2013, Amazon.com, site visited Apr. 27, 2022, url: https://www.amazon.com/dp/BOOCBA41 RU/ref=sbl dpx lighting-table-lamps BOOFM13MOC 0?language=en US (Year: 2013) 6 pages.

United States Patent and Trademark Office; Non-Final Office Action for U.S. Appl. No. 29/698,913; dated May 5, 2022; 9 pages.

United States Patent and Trademark Office; Notice of Allowance for U.S. Appl. No. 16/999,319; dated Apr. 28, 2022; 7 pages.

* cited by examiner

READING LAMP

CROSS-REFERENCE TO RELATED APPLICATIONS

This application claims priority to CN Patent Application No. 201911078992.9 filed Nov. 7, 2019, which is incorporated herein by reference in its entirety.

BACKGROUND OF THE DISCLOSURE

This disclosure relates generally to an accessory for furniture, in particular to a detachable lighting appliance, such as a reading lamp, for electrical connection to a furniture item.

As living standards improve, the demand for a higher quality of life is steadily increasing. Traditional furniture can no longer meet people's requirements in daily life, giving way to more and more intelligent furniture in everyday life. For example, some furniture items, such as sofas and beds, are equipped with electrical appliances, such as a reading lamp that is detachable from the furniture item. The base of the reading lamp can be connected to an electrical installation base in the furniture item. This connection can use an external power source to charge the reading lamp bulb with the use of an external main lead or power cord that electrically connects the reading lamp to an external socket. Such a design affects the overall visual appearance of the furniture item and use of the lighting component can be inconvenient due to the presence of the main lead or power cord and connection to the external socket.

Alternatively, the connection between the circuit structure inside the reading lamp base and the installation base can power the reading lamp through the installation base provided in the furniture item. However, with existing technology, integrating the electrical connector into the inside of the lamp requires a hole or slot formed on the installation base, and a protruding connecting bar or button on the detachable reading lamp base that can be fit into the hole or slot. A relatively large caliber interface is required to ensure electrical connectivity between the reading lamp base and the installation base. In addition, when the detachable reading lamp is removed from the base, the installation base hole or slot is exposed, which will affect the visual appearance of the furniture item, collect dirt, and even pose a risk of electric shock.

In view of the above deficiencies for connection of electrical appliances to furniture items, a need exists for a more convenient and safer detachable electrical accessory for facilitating connection between electrical accessories and furniture items.

BRIEF DESCRIPTION OF THE EXEMPLARY EMBODIMENTS

According to an aspect, the exemplary embodiments include a reading lamp. The reading lamp includes a lamp top portion having a tubular housing. The reading lamp further includes a support column having a first end and a second end opposite the first end. The support column includes a column wall defining a hollow interior of the support column. The reading lamp further includes a swiveling joint assembly provided between and joining the lamp top portion and the first end of the support column. The swiveling joint assembly enables one or more of a polyaxial and rotational movement of the lamp top portion relative to the support column.

In another aspect, the exemplary embodiments relate to a reading lamp for connection to an external power supply. The reading lamp includes a lamp top portion having a tubular housing, and a support column having a first end and a second end opposite the first end. The tubular housing is non-rotatably coupled to a tubular housing adapter, and the support column first end is non-rotatably coupled to a support column adapter. The support column includes a column wall defining a hollow interior of the support column. The reading lamp further includes an adapter pipe rotatably coupled to each of the tubular housing adapter and the support column adapter. The tubular housing adapter and the adapter pipe define a first rotational joint through which the lamp top portion rotates about a first rotational axis, and the support column adapter and the adapter pipe define a second rotational joint through which the lamp top portion rotates about a second rotational axis that is transverse to a third axis of the support column. A lamp power interface set is positioned in the hollow interior of the support column in a spaced apart relationship from the second end of the support column. A length between a lower surface of the lamp power interface set and the support column second end is equal to a length of a retention portion of the support column. The retention portion and lower surface of the power interface set are together dimensioned for receiving and connecting to an external power source.

In a further aspect, the exemplary embodiments relate to a method for powering and operating a reading lamp, comprising inserting a lower end of a support column of the reading lamp into a retaining structure. The reading lamp includes a lamp top portion with a tubular housing non-rotatably coupled to a tubular housing adapter, a support column having a support column upper end non-rotatably coupled to a support column adapter, and a support column lower end opposite the support column upper end. The support column includes a column wall defining a hollow interior of the support column. The reading lamp further includes an adapter pipe rotatably coupled to each of the tubular housing adapter and the support column adapter, wherein the tubular housing adapter and the adapter pipe define a first rotational joint through which the lamp top portion rotates about a first rotational axis, and wherein the support column adapter and the adapter pipe define a second rotational joint through which the lamp top portion rotates about a second rotational axis that is transverse to a third axis of the support column. The method further includes contacting an electrically contactable projection formed on a lower surface of a lamp power interface set positioned within a hollow interior of the support column in a spaced apart relationship from the lower end of the support column with an electrically contactable connection positioned within the retaining structure.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
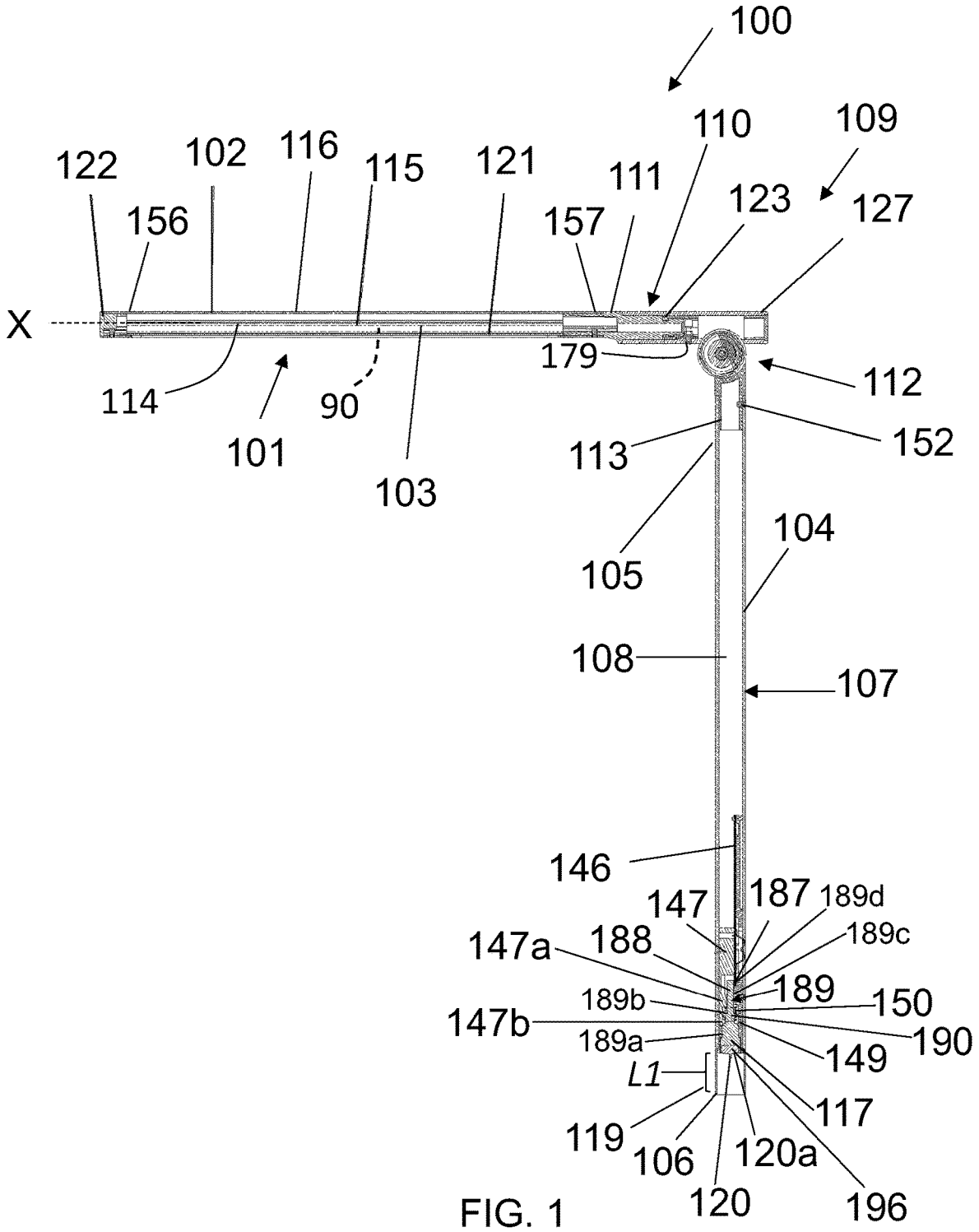
FIG. 1 is a side, partial cross-sectional view of a reading lamp, according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments.

For purposes of this disclosure, "connected" means in electrical contact or communication, except where the disclosure makes clear that "connected" refers to a purely physical connection. Electrical contact or communication includes, for example and without limitation, one or more physical connections between conductive components, either directly or through intermediate conductive components or relays, and/or as described for particular aspects of this disclosure. Electrical contact or communication may provide, for example and without limitation, a path for transmission of electrical power, and the like.

Where the disclosure makes clear that "connected" refers to a purely physical connection or joining, "connected", for purposes of this disclosure, means integrally formed, or securely, separably, or removably joined by known techniques consistent with the disclosure.

For purposes of this disclosure, relative terms including, without limitation, "top", "bottom", "upper", "lower", "above", "below", "within", etc. are used to aid the description of, e.g., configurations of features as shown in the accompanying figures, and otherwise as the disclosure makes clear. Such relative terms do not imply any particular dimension or delineation of or between features except where the disclosure makes clear.

For purposes of this disclosure, terms including, without limitation, "first", "second", "third" and "fourth" are used for descriptive purposes only and without limitation with respect to, e.g., relative importance or to imply the quantity of indicated technical features. Thus, a feature defined by "first", "second", "third" or "fourth" may explicitly or implicitly include one or more of these features.

Exemplary embodiments described herein relate generally to devices, systems, and methods for a reading lamp. More specifically, the exemplary embodiments relate to a reading lamp configured to detachably, electrically connect to an external power source via an electrical connection provided in a furniture item retaining structure. For purposes of this disclosure, the phrases "devices," "systems," and "methods" may be used either individually or in any combination referring without limitation to disclosed components, grouping, arrangements, steps, functions, or processes.

Reference is made herein to the exemplary embodiment (s) of a reading lamp. The exemplary reading lamp includes, among other things, a lamp top portion, a swiveling joint assembly, and a support column.

In an aspect, the support column may be hollow and a power interface set may be provided inside a hollow interior of the support column. The power interface set may be installed above a second, bottom, or a lower end of the support column.

In an aspect, a gap formed between the bottom surface of the power interface set and the second, bottom, or lower end of the support column may be the same as that between the bottom of the support column and a surface of a ring-shaped support slot formed in a retention structure provided on a furniture item, when the support column is inserted in the retention structure. The support column may be inserted into the support slot formed in the retention structure for attachment to the furniture item.

In an aspect, the gap between the lower end of the support column and the bottom surface of the power interface set positioned within the hollow interior of the support column away from the lower end of the support column may be the same as a depth of the support slot formed in the retention structure. Therefore, when the lower end of the support column is inserted into the ring-shaped support slot of the retention structure, the reading lamp is supported. According to an aspect, the power interface set of the support column may be a male power interface set, meaning, without limitation, that a projection is provided on the bottom surface of the power interface set, and the power interface provided in the retention structure may be a female power interface, such that when the lower end of the support column is inserted into the ring-shaped slot of the retention structure, the male power interface set may connect to the female power interface by a pin/slot-type connection of the male power interface set into the female power interface set.

In an aspect, the power interface set and/or the power interface of the retention structure may be at least one of a magnetic interface or a direct current (DC) circuit interface. The power interface set may be coupled to and/or electrically connected to an electrically contactable connection installed in the retention structure, for example by a magnetic joint formed between respective conductive components of the power interface set and the electrically contactable connection in the retention structure.

In an aspect, the support column may be made of stainless steel, aluminum, aluminum alloy, carbon fiber, or a similar hard material consistent with the disclosure.

In an aspect, the swiveling joint assembly may comprise a first rotational joint or a first swivel part, and a second rotational joint or a second swiveling part. According to an aspect, the swiveling joint assembly comprising the first rotational joint and the second rotational joint in combination may enable a light-emitting unit, such as a light bulb or the like, provided in the lamp top set to rotate polyaxially or generally in different directions.

In an aspect, the first rotational joint may be formed from a tubular housing adapter, an adapter receiving collar, an adapter pipe, and a swivel limiting pin. When the first rotational joint rotates around its axis, components of the lamp top portion, namely, a tubular housing and the light bulb provided in the housing, also rotates. According to an aspect, the housing may be made of stainless steel, aluminum, aluminum alloy, carbon fiber, or a similar hard material consistent with the disclosure.

In an aspect, the second rotational joint may include a support column adapter, a first bearing housing component, a second bearing housing component, a bushing assembly, and a bushing pin. According to an aspect, the bushing assembly includes a large bushing and a small bushing positioned adjacent one or both of the first bearing housing component and the second bearing housing component.

In an aspect, the lamp top portion may include an aluminum tubular housing, a light-emitting unit or a light bulb, and a circuit board with drive control, which controls the switch state and illuminance of the light-emitting unit.

In an aspect, the circuit board may include a touch sensor unit that can sense touch and other interactions including, without limitation, vibration, and thus trigger the control board to switch the light-emitting unit off or on and adjust its illuminance.

For purposes of illustrating features of the embodiments, an exemplary embodiment will now be introduced and referenced throughout the disclosure. It will be understood that this example and other exemplary embodiments described in this disclosure are illustrative and not limiting and are provided for illustrating the exemplary features of a reading lamp and a reading lamp configured for connection with an external power source as described throughout this disclosure for explanatory purposes.

With reference to FIG. 1, an exemplary embodiment of a reading lamp 100 includes a lamp top set 101, a swiveling joint assembly 109, and a support column 104. The swiveling joint assembly 109 is connected to each of the lamp top set 101 and the support column 104 and thereby joins the lamp set 101 to the support column 104, and defines a first rotational joint 110 and a second rotational joint 112 for rotating the lamp top set 101 relative to the support column 104, as discussed below. The lamp top set 101 includes a tubular housing 102 having a first end 156 and a second end 157 opposite the first end 156. A choke plug 122 may be inserted in the first end 156 of the tubular housing 102, to seal the tubular housing 102 for aesthetics and safety. The tubular housing 102 houses a first control board 103 (as further shown in FIG. 2A) and is configured for receiving a light bulb 90 connected to the first control board 103, according to well-known principles and techniques, within an interior 114 of the tubular housing 102 at an open portion 115 of the tubular housing 102. The open portion 115 of the tubular housing 102 is a portion of the tubular housing 102 in which a portion of a housing wall 116 defining the interior 114 of the tubular housing 102 is replaced by a lampshade 121 (as further shown in FIG. 2A) for covering the light bulb 90. For purposes of this disclosure, a "light bulb" may refer to, without limitation, any known lamp lighting element such as an incandescent, fluorescent, halogen, or light-emitting diode (LED) light bulb, an LED tube, or the like. Light bulbs having a shape and dimensions for use in particular applications and fixtures are well known, and the light bulb 90 may be shaped and dimensioned for use with an exemplary reading lamp 100 as described throughout the disclosure. The first control board 103 may be any known control board for controlling a power state and luminance level of a light bulb or light source, consistent with this disclosure.

The first rotational joint 110 includes a tubular housing adapter 111, an adapter receiving collar 123, and an adapter pipe 127. According to an aspect, the tubular housing adapter 111, the adapter receiving collar 123, and the adapter pipe 127 together enable rotation of the lamp top set 101, namely the tubular housing 102, about the first rotational axis X of the lamp top set 101. The second rotational joint 112 includes a support column adapter 113 that is non-rotatably coupled to a support column first or upper end 105 and secured via a screw 152. The support column adapter 113 is rotatably coupled to the adapter pipe 127 (as further shown in FIG. 2C).

The support column 104 includes a first, or upper, end 105, and a second, or lower, end 106 opposite the first end 105. The support column 104 includes a column wall 107 defining a hollow interior 108 of the support column 104. According to an aspect, the support column 104 may be made from, without limitation, stainless steel tube, aluminum or aluminum alloy tube, carbon fiber pipe or other similar hard materials. The support column 104 includes electrical and related components housed inside the hollow interior 108. In an aspect, a second control board 146 is housed in the hollow interior 108 of the support column 104. The second control board 146 may be any known control board for controlling a power state and luminance level of a light bulb or light source.

According to an aspect, one or both of the first control board 103 and the second control board 146 may include a drive control to enable the respective control board to control a switch state and illuminance of the light bulb 90. According to an aspect, the first control board 103 and/or the second control board 146 may use pulse width modulation ("PWM") to control the luminance level of the light bulb 90. When the input power is adjusted to a pulse constant-current source in this mode, the luminance level of the light bulb 90 can be changed as the width of the pulse changes. In an aspect, the first control board 103 and/or second control board 146 includes a touch sensor unit, for example, touch sensor 191 provided in the second control board 146, which can sense touch and other interaction with vibration, capacitance, and the like according to known techniques, and thus trigger the control board/drive control to switch the light bulb 90 off/on and adjust its luminance level. In other words, the drive control is touch-enabled. According to an aspect of the exemplary embodiment(s), a touch sensor provided in the lamp top portion 101 may be configured to transmit a signal to the first control board 103 and a touch sensor provided in the support column 104 may be configured to transmit a signal to the second control board 146. In a further aspect, the first control board 103 may control function of the light bulb 90 and the first control board 103 may communicate, e.g., receive control signals, from the second control board 146 by wiring, wireless communication such as radio frequency (RF) transmission, or other known techniques. For example, the first control board 103 may receive and control the function of the light bulb 90 based on control signals originating at the second control board 146 via, e.g., a touch sensor of the second control board 146.

Figure 4A:
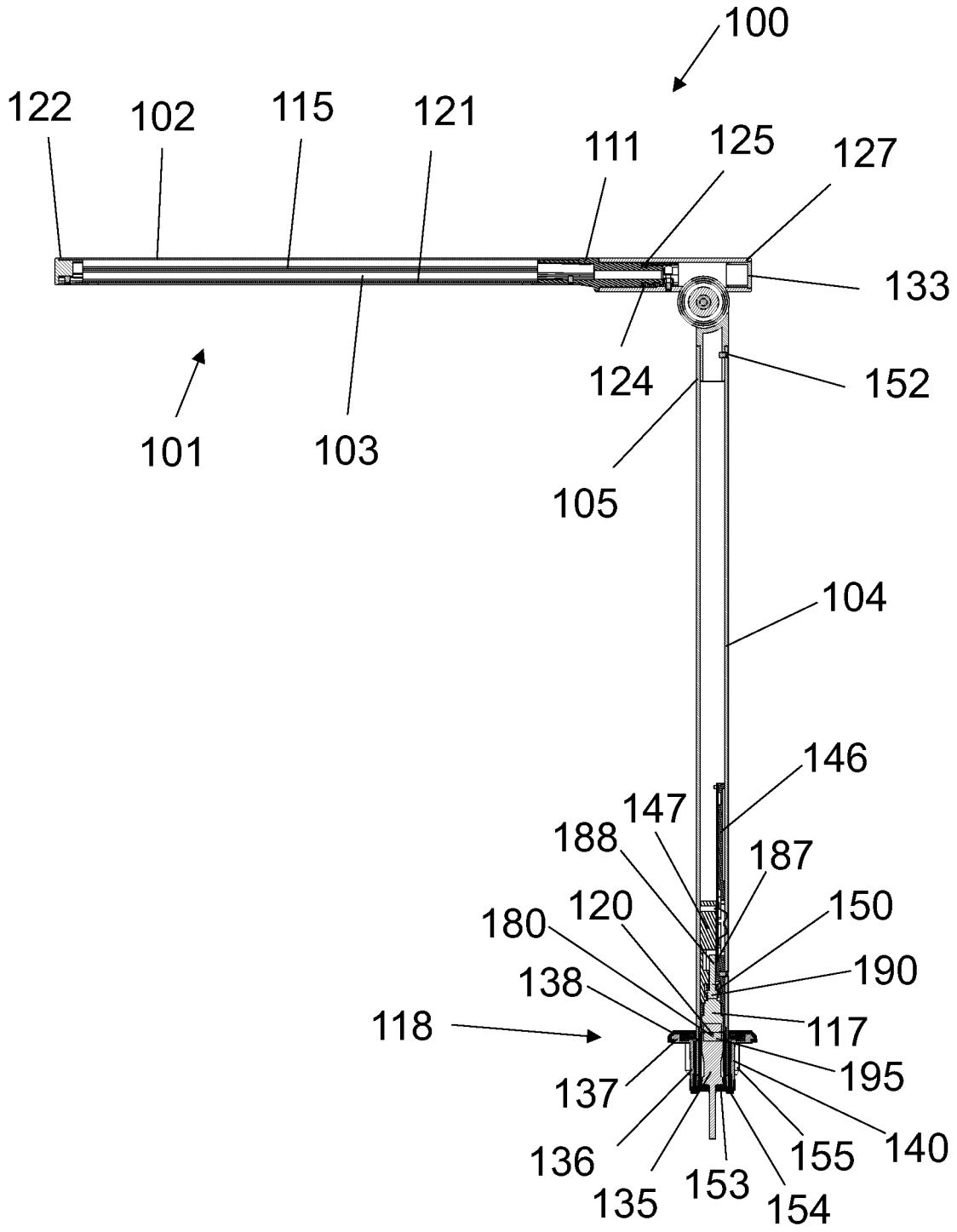
FIG. 4A is a side, partial cross-sectional view of the reading lamp and retaining structure in an assembled configuration, according to an exemplary embodiment.
Figure 4B:
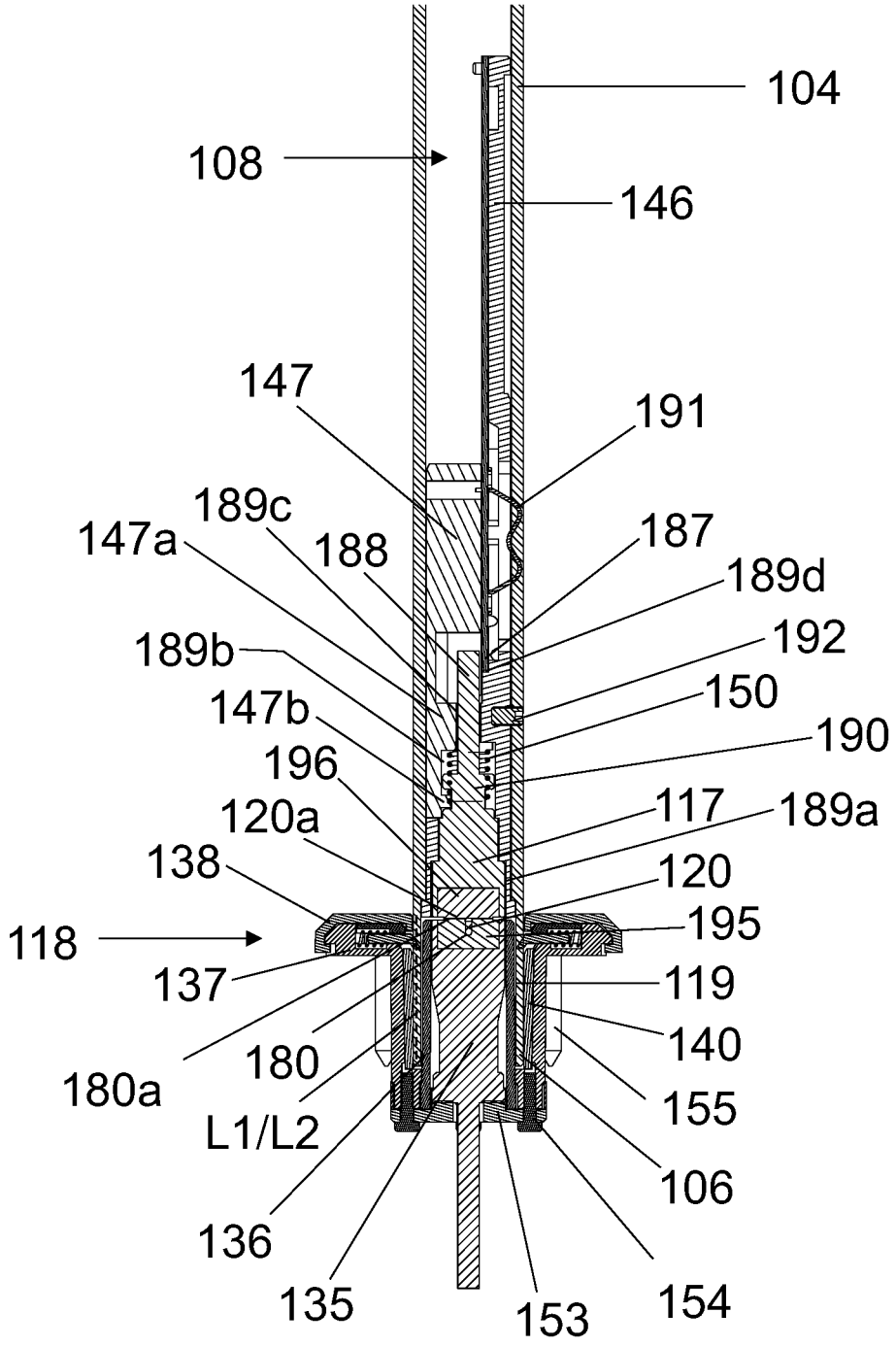
FIG. 4B is a cross-sectional cutaway side view of the connection between the reading lamp and retaining structure of FIG. 4A, according to an exemplary embodiment.

With continued reference to the exemplary embodiment shown in FIG. 1, the support column 104 houses a male power interface set 117 within the hollow interior 108 at a position spaced apart from the second end 106 of the support column 104. The male power interface set 117 may include an electrically contactable projection 120 on a lower surface 120*a* of the male power interface set 117. In an aspect, the lower portion of the male power interface set 117 may comprise a magnetic contact block 196 from which the electrically contactable projection 120 extends. The contact block 196 may be configured to automatically magnetically couple to a corresponding female power interface set for electrical connection therewith, for example, as illustrated in FIGS. 4A-4B. The portion of the support column 104 extending from the second end 106 to a position radially adjacent to the lower surface 120*a* of the male power interface set 117 defines a retention portion 119 of the support column 104. According to an aspect, the retention portion 119 and the male power interface set 117 are together dimensioned for connecting to an external power source, as described below.

Figure 2A:
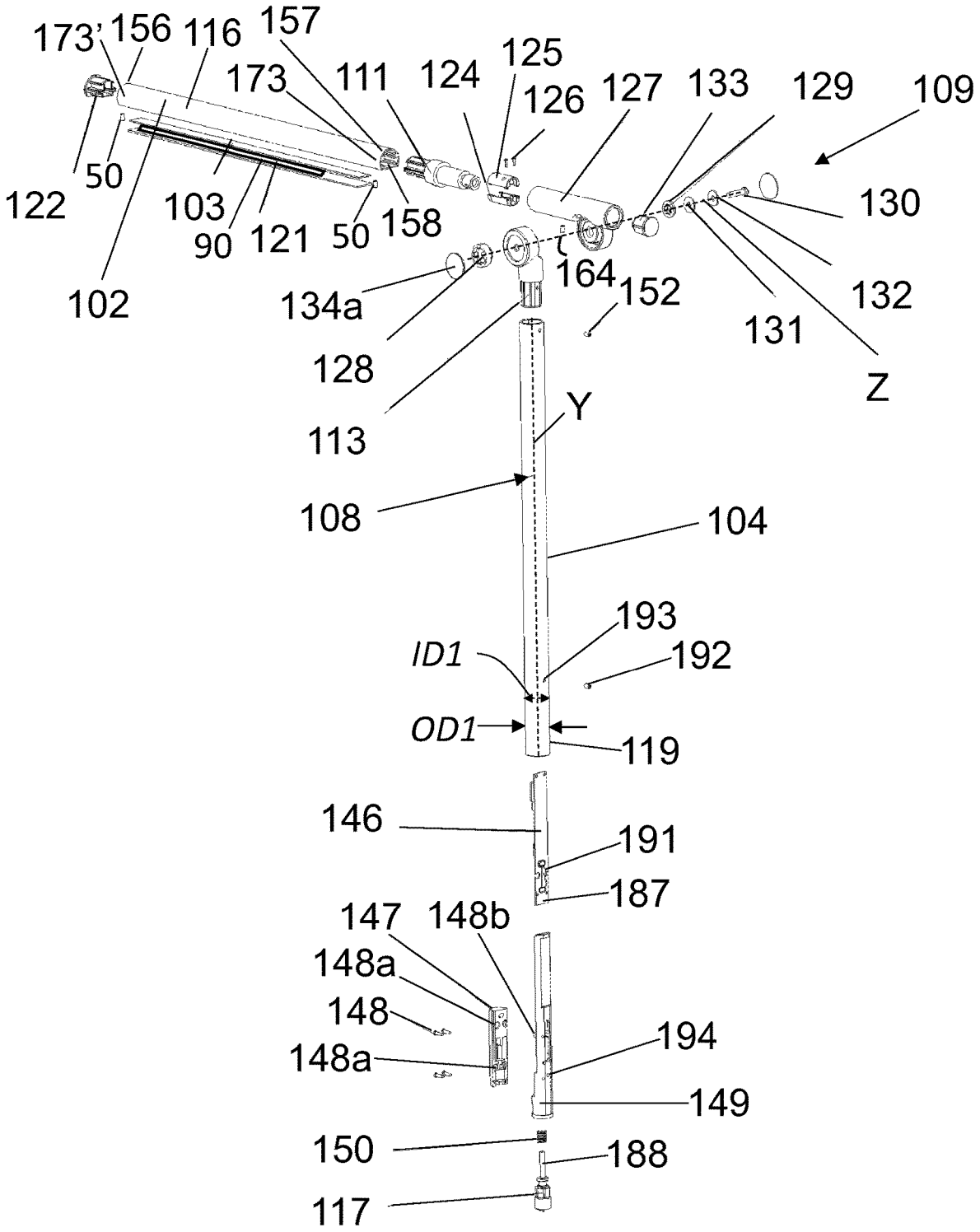
FIG. 2A is a decomposition diagram of the reading lamp, according to an exemplary embodiment.
Figure 2B:
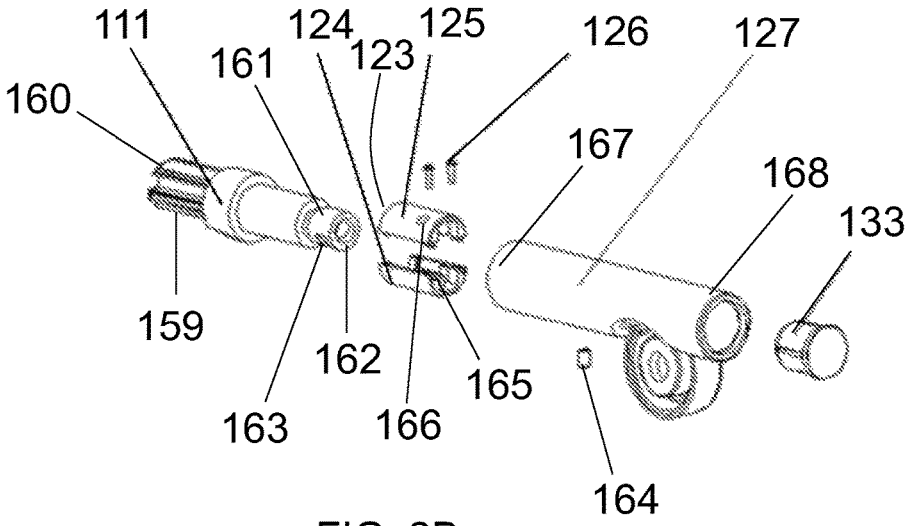
FIG. 2B is a decomposition diagram of a first rotational joint of the reading lamp, according to an exemplary embodiment.
Figure 2C:
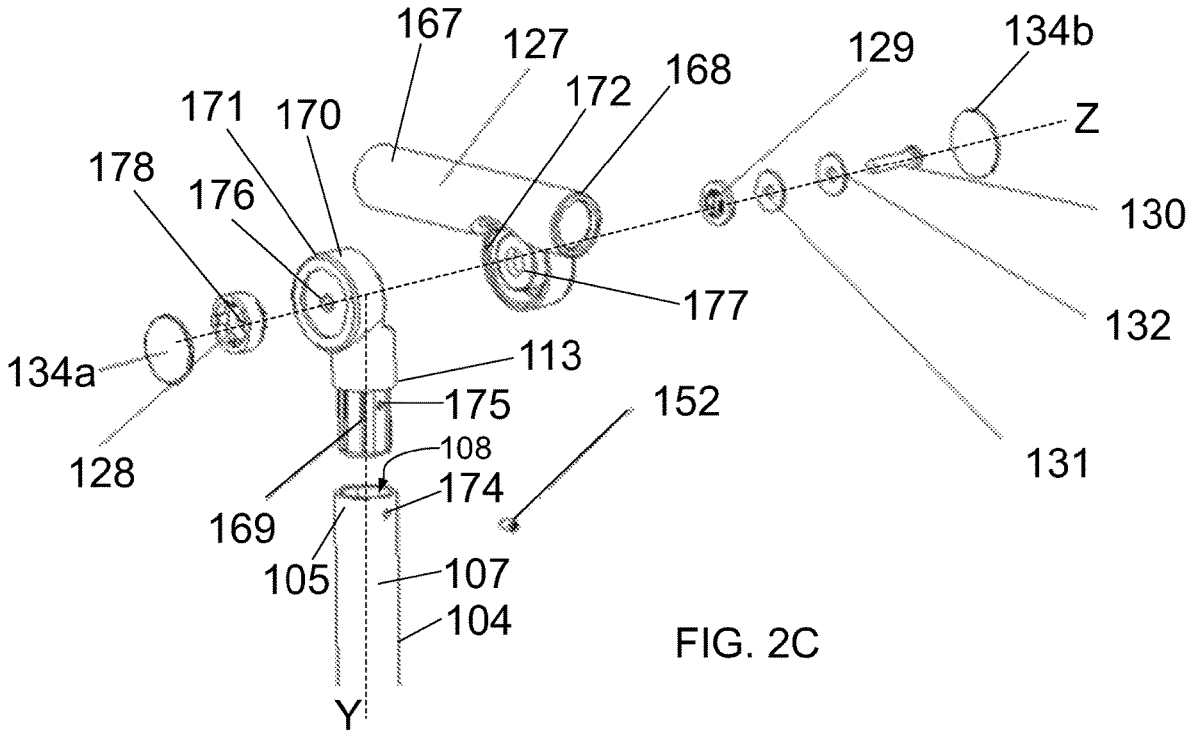
FIG. 2C is a decomposition diagram of a second rotational joint of the reading lamp, according to an exemplary embodiment.

With continuing reference to FIG. 1, and further reference to FIGS. 2A-2C, the tubular housing adapter 111 is connected to the second end 157 of the tubular housing 102 at a closed portion 173 of the tubular housing 102, the closed portion 173 being a portion of the tubular housing 102, for example, a terminal portion of the tubular housing 102, in which a radial cross-section of the housing wall 116 of the tubular housing 102 is continuous, i.e., does not include any portion that is open or replaced by another structure. The tubular housing 102 further includes a closed end portion 173' opposite the closed portion 173 and adjacent to the first end 156 of the tubular housing 102. According to an aspect, the tubular housing adapter 111 is non-rotatably coupled to the tubular housing 102. Fasteners 50 such as screws or dowels may secure the housing adapter 111 and the choke plug 122 to the tubular housing 102 through, e.g., aligned receiving holes respectively through the closed portion 173 and the tubular housing adapter 111, the closed end portion 173' and the choke plug 122. The tubular housing adapter 111 includes, at a first end 160, external ribs 159 that connect to complementary internal tracks 158 formed on an inner surface of the closed portion 173, thereby connecting the tubular housing adapter 111 to the tubular housing 102. A second end of the tubular housing adapter 161, opposite the first end 160, includes a rotating head portion 162 within which a swivel limiting slot 163 is formed. The adapter receiving collar 123 (FIG. 2B) may be secured around the rotating head portion 162. In the exemplary embodiment, the adapter receiving collar 123 is formed from a first collar component 124 and a second collar component 125 that are secured together via screws 126 inserted in screw holes 166. According to an aspect, an adapter receiving collar pin hole 165 is formed through the second collar component 125 of the adapter receiving collar 123 and aligned with the swivel limiting slot 163 when the adapter receiving collar 123 is secured around the rotating head portion 162.

The tubular housing adapter second end 161 and the adapter receiving collar 123 together are inserted into an open first end 167 of the adapter pipe 127. A choke plug 133 may be inserted in an open second end 168 of the adapter pipe 127 to seal the adapter pipe 127 for aesthetics and safety. According to an aspect, the adapter receiving collar 123 is dimensioned with an outer diameter and the adapter pipe 127 is dimensioned with a corresponding inner diameter such that the adapter receiving collar 123 is received and fits snugly within the adapter pipe 127, for example, with an outer surface of the adapter receiving collar 123 abutting or frictionally contacting an inner surface of the adapter pipe 127. The tubular housing adapter 111 second end 161 is inserted into the adapter pipe 127 to a position at which the swivel limiting slot 163 and the adapter receiving collar pin hole 165 are aligned with a swivel limiting pin 164 inserted through each of an adapter pipe pin hole 179 formed through the adapter pipe 127, the adapter receiving collar pin hole 165, and the swivel limiting slot 163. According to an aspect, the tubular housing adapter 111, and by connection the tubular housing 102, may rotate through a range defined by a distance that the swivel limiting slot 163 may pass around the swivel limiting pin 164, before the swivel limiting pin 164 is stopped against a wall bounding the swivel limiting slot 163. In an exemplary embodiment, the degree of rotation defined by the distance that the swivel limiting slot 163 may travel is, without limitation, from about −45 degrees to about 45 degrees.

A support column adapter 113 is connected to the first end 105 of the support column 104. The support column adapter 113 includes a first support column adapter end 169 that is dimensionally sized and shaped to be inserted into the hollow interior 108 of the support column 104. A screw 152 may be inserted through a screw hole 174 formed in the column wall 107 and a screw hole 175 formed in the first support column adapter end 169 to secure the support column adapter 113 to the support column wall 107 and prevent rotation of the support column adapter 113 within the hollow interior 108. A second support column adapter end 170, opposite the first support column adapter end 169, includes a first bearing housing component 171. A first bearing housing pin hole 176 is formed along an axis Z through a center of the first bearing housing component 171. The first bearing housing component 171 is rotatably coupled with a second bearing housing component 172 provided in a fixed position on the adapter pipe 127 away from the first end 167 of the adapter pipe 127. A second bearing housing pin hole 177 is formed along the axis Z through a center of the second bearing housing component 172 in axial alignment with the first bearing housing pin hole 176. According to an aspect, the axis Z of the first bearing housing component 171 and second bearing housing component 172 is substantially transverse to an axis Y of the support column 104. A bushing assembly may be positioned adjacent the first bearing housing component 171 and/or the second bearing housing component 172 to facilitate rotation of the bearing housing components 171, 172 relative to one another. In the exemplary embodiment shown, e.g., in FIGS. 2A and 2C, the bushing assembly includes a large bushing 128 provided adjacent the first bearing housing component 171 on a side opposite the second bearing housing component 172, and a small bushing 129 provided adjacent the second bearing housing component 172 on a side opposite the first bearing housing component 171. A first gasket 131 and second gasket 132 are included in the bushing assembly. Each bushing component (e.g., first gasket 131, second gasket 132, small bushing 129, and large bushing 128) includes a bushing pin hole (for example, a large bushing pin hole 178) formed through a center of the bushing component. A bushing pin 130 is inserted through each of the bushing pin holes of each bushing component, the first bearing housing pin hole 176, and the second bearing housing pin hole 177, to rotatably couple the adapter pipe 127 to the support column adapter 113, thereby connecting the tubular housing 102 (via the tubular housing adapter 111) to the support column 104. According to an aspect, a decorative gasket 134*a* may be provided to cover the large bushing 128 and a decorative gasket 134*b* may be provided to cover the small bushing 129 and bushing pin 130.

With reference to FIGS. 1 and 2A, the retention portion 119 may be defined by a length L1 of the column wall 107 extending from the second end 106 of the support column 104 towards the first end 105 of the support column 104. In an assembled configuration (FIG. 1), the length L1 of the retention portion 119 may be defined, without limitation, by the distance between the second end 106 of the support column 104 and the lower surface 120*a* of the male power interface set 117, as an aspect of an exemplary connection between the retention portion 119 and a support base 118 (FIG. 3) as described further below. The retention portion 119 also includes an outer diameter OD1 (defined by the support column wall 107) and an inner diameter ID1 (defined by the hollow interior 118) dimensioned according to aspects of the exemplary connection.

Components for connection to the power interface set 117 in an exemplary embodiment are shown in an assembled state in FIG. 1 and in an exploded view in FIG. 2A. A male head support 149 is provided on an upper portion of the power interface set 117 to electrically and physically couple the power interface set 117 to the second drive control board 146. A wire pressing block structure 147 is connected to the male head support 149 by screws 148 that pass through fastener holes 148*a* on the wire pressing block structure 147 and are received in screw receptacles 148*b* on the male head support 149. A portion of the second drive control board 146 is sandwiched between the wire pressing block structure 147 and the male head support 149 and includes an electrical connection portion 187 positioned for electrically contacting a conductor 188 that is connected to or integrally formed with the power interface set 117 and extends away from the power interface set 117, on a side of the power interface set 117 opposite the lower surface 120*a*, in a direction towards the first end 105 of the support column 104.

The wire pressing block structure 147 and the male head support 149 are respectively shaped to together form a power interface retaining channel 189. The power interface set 117 including the conductor 188 is received in the power interface retaining channel 189. In the exemplary embodiment shown, e.g., in FIGS. 1 and 4B, the power interface retaining channel 189 includes, among other things: a power interface portion 189*a* dimensioned for receiving the power interface set 117; a pressure spring portion 189*b* dimensioned for receiving an enlarged region 190 of the conductor 188 and a pressure spring 150 engaged with and applying a biasing force to the enlarged region 190 in a direction towards the second end 106 of the support column 104; a conductor collar portion 189*c* dimensioned for receiving the conductor 188 therethrough and fixing a position of the conductor 188 relative to the electrical connection portion 187 of the second drive control board 146; and an interface gap 189*d* through which the conductor 188 and the second drive control board 146 may connect. In an exemplary embodiment, the wire pressing block structure 147 and the male head support 149 are formed from an insulating material, to prevent errant electrical contact or discharge from the power interface set 117/conductor 188.

The pressure spring portion 189*b* is defined by a first shoulder 147*a* and a second shoulder 147*b* of the wire pressing block structure 147. The first shoulder 147*a* and the second shoulder 147*b* define a bounded space within which the enlarged region 190 of the conductor 188 is retained by the first shoulder 147*a* and the second shoulder 147*b* acting as barriers. The first shoulder 147*a* may also serve as a surface for opposing the biasing force of the pressuring spring 150 relative to the enlarged region 190 of the conductor 188. The biasing force applied by the pressure spring 150 to the enlarged region 190, in a direction away from the first shoulder 147*a*, may enhance an electrical connection between the power interface set 117 and an electrical connector, e.g., electrically contactable surface 180*a* (FIG. 4B) of the support base 118 as described further below. However, the exemplary embodiments of an assembly including the power interface retaining channel 189, the power interface set 117, and the conductor 188 including the enlarged region 190 do not necessarily require a pressure spring 150. The pressure spring portion 150 may nonetheless serve to retain the enlarged portion 190. In an aspect, the pressure spring 150 may The wire pressing block structure 147 and the male head support 149 together form a cylindrical structure that is dimensioned complementarily to the hollow interior 118 of the support column 104 and received therein, along with the second drive control board 146 and the power interface set 117 including the conductor 188, in an assembled state. A screw or fastener 192 is inserted through a screw hole 193 formed in the wall 107 of the support column 104 and into a corresponding screw receiver 194 on the male head support 149, to fix the male head support 149 and thereby the second drive control board 146, power interface set 117, and wire pressing block structure 147 in position within the hollow interior 118.

Figure 3:
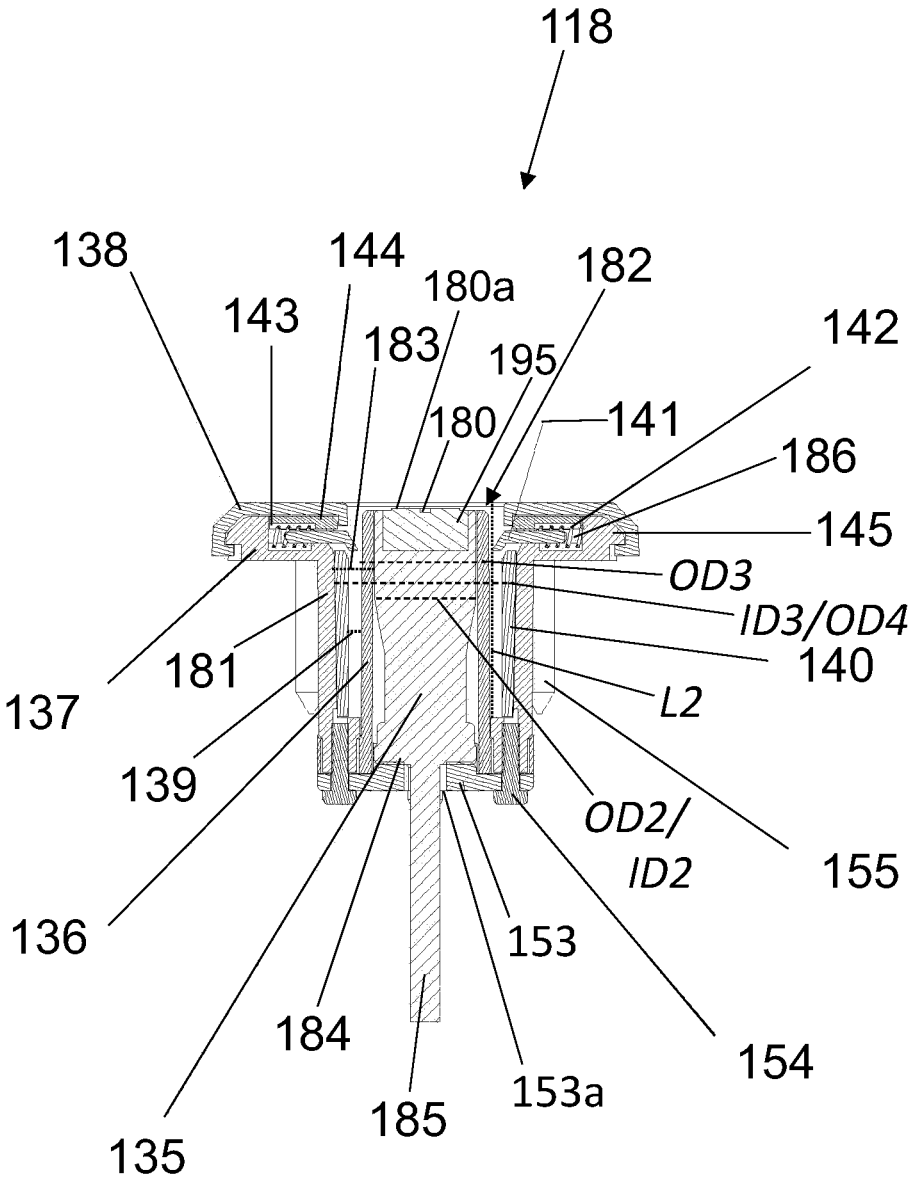
FIG. 3 is a cross-sectional side elevated view of a retaining structure, according to an exemplary embodiment.

FIG. 3 illustrates a cross-section view of a retaining structure or support base 118 that is configured to receive the retention portion 119 of the support column 104. According to an aspect, the support base 118 is a base for the reading lamp 100 and may be installed within a furniture item, such as the arm of a sofa, frame of a bed, tabletop on, e.g., a nightstand, and the like. As illustrated, the support base 118 includes a chamber 182 with a hollow interior defined by a chamber wall 181, and a cover plate 138 may be coupled or otherwise secured to a top end flange 137 of the support base 118, for example, via coupling with a fastening portion 145 formed along a peripheral edge of the top end flange 137. A female power interface set 135 is positioned within the chamber 182. According to an aspect, the female power interface set 135 is positioned in the chamber 182 through a hole formed centrally in the cover plate 138, such that an electrically contactable surface 180*a* of the female power interface set 135 is contactable with the electrically contactable projection 120 of the male power interface set 117, as illustrated in FIG. 4B. In an aspect, the slot 180 may be provided in an electrically contactable surface 180*a* of a contact block 195 positioned in an upper part of the female power interface set 135. One or more fasteners 155 may extend through the top end flange 137 to secure the support base 118 to a furniture item.

According to the exemplary embodiment shown in FIG. 3, a bottom end 184 of the female power interface set 135 is positioned on and in contact with a pressing block structure 153. A circular circuit 185 may extend downwardly away from the bottom end 184 of the female power interface set 135 through a hole 153*a* formed in the pressing block structure 153. The circular circuit 185 may be configured for and, in use, electrically connected to, without limitation, an electrical receptacle assembly within the furniture item and including a connection to a power plug or other connection to a power source such as a wall outlet. In use, a power source such as a wall outlet would provide power to the circular circuit 185 via the electrical receptacle assembly or the like, and the circular circuit 185 would relay the power to the female power interface set 135. According to an aspect, the pressing block structure 153 may be coupled to the chamber wall 182 via one or more fasteners 154.

The female power interface set 135 is positioned at the center of the support base 118. According to an aspect, the female power interface set 135 includes a magnetic joint power interface set configured as a female electrical connection set. An electrically contactable surface 180*a* of the female power interface set 135 including a socket 180 for receiving the electrically contactable projection 120 on the lower surface 120*a* of the male power interface set 117 may be positioned to abut the male power interface set 117 at a position adjacent to or within the opening formed in the cover plate 138, as illustrated in FIGS. 4A-4B. In an aspect, the male power interface set 117 and female power interface set 135 may be configured to electrically couple via, without limitation, male/female connectors (i.e., pin and socket) and/or a direct current ("DC") electrical connection including DC electrical wires. In the exemplary embodiment, the female power interface set 135 includes a contact block 195 provided within an upper portion of the female power interface set 135. In an aspect, the contact block 195 is a magnetic connector configured for automatically magnetically coupling with the corresponding magnetic contact block 196 of the male power interface set 117. The projection 120 of the male power interface set 117 extends into the slot 180 provided in the electrically contactable surface 180*a* of the female power interface contact block 195 for electrical connection to the female power interface set 135 via the contact block 195.

The female power interface set 135 has an outer diameter OD2 that is less than an inner diameter ID3 of the chamber 182 as defined by the chamber wall 181. This forms an annular support gap 183 between the female power interface set 135 and the chamber wall 181. The annular support gap 183 may receive at least a portion of a casing 136 and a tubing collar 140, thereby defining an annular support slot 139 into which the retention portion 119 is received. The female power interface set 135 may be provided in the casing 136 positioned in the annular support gap 183. In an aspect, the casing 136 may have an inner diameter ID2 substantially equal to the outer diameter OD2 of the female power interface set 135. The tubing collar 140 positioned in the annular support gap 183 may be arranged so that the casing 136 is positioned within an interior portion of the tubing collar 140. According to an aspect, an outer diameter OD4 of the tubing collar 140 may be substantially equal to the inner diameter ID3 of the chamber 181 defined by the chamber wall 182.

According to an aspect, the support base 118 includes one or more baffles 141 and a spring pressing block 144. The baffle 141 is configured to be provided in a flange groove 143 formed in the top end flange 137 of the support base 118. According to an aspect, the baffle 141 helps to prevent foreign materials or objects from falling into the annular support gap 183, and also functions as a clamp to help provide support for the components of the support base 118. The baffle 141 may include or be outfitted with baffle springs 142 arranged such that each baffle spring 142 is in contact with a wall defining the flange groove 143. The baffle springs 142 may be sleeved on baffle spring guide columns 186. To facilitate this arrangement, the baffle springs 142 are larger than the baffle spring guide columns 186. The baffle springs 142 are at least partially compressible so that they move between a compressed state and an uncompressed state. In an aspect, when the baffle springs 142 are in the uncompressed state, a sloped inner portion of the baffle 141 extends into the annular support gap 183 formed between the chamber wall 181 and the female power interface set 135. The baffle springs 142 may be elastically pressed towards the central hollow interior of the chamber 182 by a biasing force of the baffle springs 142.

The spring pressing block 144 may be arranged under the cover plate 138 and above the baffle 141 to cover the baffle 141 and the baffle spring 142. The spring pressing block 144 helps to prevent or substantially reduces foreign matter from falling into any spaces (such as slots or openings) of the support base 118. The spring pressing block 144, in combination with the baffle 141 and baffle spring 142, may work together as an elastic baffle structure that clamps the various components of the support base 118 together to ensure that they are structurally sound. When the retention portion 119 is installed into the support base 118, the column wall 107 of the support column 104 pushes the baffle portions back by compressing the baffle springs 142, and the opposing bias force provided by the baffle spring 142 against the support column wall 107 stabilizes and secures the support column 104 within the support base 118.

The reading lamp 100 and support base 118 are shown in an assembled configuration in FIGS. 4A-4B. In the assembled configuration as illustrated, the retention portion 119 of the support column 104 is inserted into the annular support slot 139 provided between the outer surface of the casing 136 and an inner surface of the tubing collar 140. According to an aspect, a wall thickness of the retention portion 119 defined by the distance between ID1 and OD1 is equal to the distance between an outer surface of the casing 136 and an inner surface of the tubing collar 140. According to an aspect, a length L2 of the annular support slot 139 is equal to the length L1 of the retention portion 119 of the support column 104 that is inserted into the annular support slot 139 and that is defined by the distance between the second end 106 of the support column 104 and the lower surface 120*a* of the male power interface set 117. According to an aspect, the second end 106 of the support column 104 contacts an upper surface of the pressing block structure 153 defining the base of the annular support slot 139. Electrical connection between the male power interface set 117 and the female power interface set 135 may be provided by automatic magnetic coupling of the contact block 195 of the female power interface set 135 with the contact block 196 of the male power interface set 196. The electrically contactable surface 120*a* of the contact block 196 of the male power interface set 117 is placed in contact with the electrically contactable surface 180*a* of the contact block 195 of the female power interface set 135. In an aspect, the electrically contactable projection 120 of the male power interface set 117 is inserted into the slot 180 of the female power interface set 135 for electrical contact between the male power interface set 117 and the female power interface set 135 to provide electrical power to the reading lamp 100.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a"

(or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower", etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A reading lamp, comprising:

a lamp top set including a tubular housing;

a support column having a first end, a second end opposite the first end, the support column including a column wall defining a hollow interior of the support column; and a swiveling joint assembly positioned between and joining the tubular housing and the first end of the support column, wherein the swiveling joint assembly further comprises:

a tubular housing adapter having a first tubular housing adapter end non-rotatably coupled to an end of the tubular housing and a second tubular housing adapter end opposite the first tubular housing adapter end;

an adapter pipe rotatably coupled to the second tubular housing adapter end;

a rotating head portion provided on the second tubular housing adapter end, wherein a swivel limiting slot is formed on the rotating head portion;

an adapter receiving collar coupled to the rotating head portion and positioned inside the adapter pipe, wherein an adapter receiving collar pin hole formed in the adapter receiving collar and an adapter pipe pin hole formed in the adapter pipe are each in alignment with the swivel limiting slot; and a swivel limiting pin inserted through each of the adapter receiving collar pin hole, the adapter pipe pin hole, and the swivel limiting slot, wherein the adapter, the adapter receiving collar, the adapter pipe, and the swivel limiting pin together define a first rotational joint through which the lamp top portion rotates about a first axis, and the swiveling joint assembly enables one or more of polyaxial and rotational movement of the tubular housing relative to the support column or the swiveling joint assembly.

2. The reading lamp of claim 1, wherein the support column is formed from one of stainless steel, aluminum alloy, and carbon fiber.

3. The reading lamp of claim 1, wherein the first rotational joint has a window of rotation of at least 90 rotational degrees.

4. The reading lamp of claim 1, wherein the swiveling joint assembly further comprises:

a support column adapter having a first support column adapter end and a second support column adapter end opposite the first support column adapter end, wherein the first support column adapter end is non-rotatably coupled to the second end of the support column;

a first bearing housing component formed on the second support column adapter end and rotatably coupled to a corresponding second bearing housing component non-rotatably coupled to an exterior surface of the adapter pipe adjacent a second end of the adapter pipe, wherein the first bearing housing component includes a first bearing housing pin hole and the second bearing housing component includes a second bearing housing pin hole in alignment with the first bearing housing pin hole;

a bushing assembly positioned adjacent at least one of the first bearing housing component and the second bearing housing component, wherein a bushing assembly pin hole is formed through the bushing assembly in alignment with the first bearing housing pin hole and the second bearing housing pin hole; and a bushing pin inserted through the bushing assembly pin hole, the first bearing housing pin hole, and the second bearing housing pin hole, wherein the support column adapter, the first bearing housing, the second bearing housing, the bushing assembly, and the bushing pin together define a second rotational joint through which the lamp top portion rotates about a second rotational axis that is transverse to a third axis of the supporting column.

5. The reading lamp of claim 4, wherein the bushing pin is colinear with the second rotational axis.

6. The reading lamp of claim 1, further comprising:

a first control board including a first drive control programmed for adjusting at least one of a power setting and a luminance of a light bulb.

7. The reading lamp of claim 6, wherein:

the drive control is touch-enabled; and a touch sensor unit is connected to the first drive control and positioned within at least one of the hollow interior of the support column and a hollow interior of the lamp top portion.

8. The reading lamp of claim 7, wherein:

the touch sensor unit is configured to transmit a signal to the first control board to trigger adjustment of at least one of a power setting and a luminance of the light bulb.

9. The reading lamp of claim 6, further comprising:

a second control board including a second drive control connected to the light bulb and programmed for adjusting at least one of a power setting and a luminance of the light bulb, wherein the first control board is positioned in the lamp top portion, and the second control board positioned within the hollow interior of the support column.

10. A reading lamp for connection to an external power supply, comprising:

a lamp top portion including a tubular housing non-rotatably coupled to a tubular housing adapter;

a support column having a support column first end non-rotatably coupled to a support column adapter and a support column second end opposite the first end, the support column including a column wall defining a hollow interior of the support column;

an adapter pipe rotatably coupled to each of the tubular housing adapter and the support column adapter, wherein the tubular housing adapter and the adapter pipe define a first rotational joint through which the lamp top portion rotates about a first rotational axis, and wherein the support column adapter and the adapter pipe define a second rotational joint through which the lamp top portion rotates about a second rotational axis that is transverse to a third axis of the support column; and a lamp power interface set positioned in the hollow interior of the support column in a spaced apart relationship from the second end of the support column, wherein a length between a lower surface of the lamp power interface set and the support column second end is equal to a length of a retention portion of the support column, and the retention portion and lower surface of the power interface set are together dimensioned for receiving and connecting to an external power source.

11. The reading lamp of claim 10, wherein the lamp top portion is rotatable about a first rotational axis of the lamp top portion and about a second rotational axis transverse to the axis of the supporting column.

12. The reading lamp of claim 10, further comprising:

a control board including a drive control connected to a light bulb provided in the lamp top portion and configured to adjust at least one of a power setting and a luminance of the light bulb; and a touch sensor unit connected to the control board and configured to transmit a signal to the circuit board to trigger adjustment of at least one of a power setting and a luminance of the light bulb.

13. The reading lamp of claim 10, wherein the lamp power interface set lower surface comprises an electrically contactable projection.

14. The reading lamp of claim 13, wherein the electrically contactable projection comprises at least one of a magnetic connection and a direct current connecting wire.

15. A method for powering and operating a reading lamp, comprising:

inserting a lower end of a support column of the reading lamp into a retaining structure, wherein the reading lamp comprises:

a lamp top portion including a tubular housing non-rotatably coupled to a tubular housing adapter;

a support column having a support column first end non-rotatably coupled to a support column adapter, and a support column second end opposite the support column first end, the support column including a column wall defining a hollow interior of the support column; and an adapter pipe rotatably coupled to each of the tubular housing adapter and the support column adapter, wherein the tubular housing adapter and the adapter pipe define a first rotational joint through which the lamp top portion rotates about a first rotational axis, and wherein the support column adapter and the adapter pipe define a second rotational joint through which the lamp top portion rotates about a second rotational axis that is transverse to a third axis of the support column, and contacting an electrically contactable projection provided on a lower surface of a lamp power interface set positioned within the hollow interior of the support column in a spaced apart relationship from the lower end of the support column with an electrically contactable connection positioned within the retaining structure.

16. The method of claim 15, wherein the step of contacting an electrically contactable projection on a lower surface of the lamp power interface set with the electrically contactable connection comprises contacting a magnetic electrically contactable projection provided on the lower surface to the electrically contactable connection.

17. The method of claim 15, wherein the step of inserting the lower end of the support column of the reading lamp into the retaining structure comprises inserting the lower end of the support column into a furniture item.

18. The method of claim 15, further comprising:

triggering a sensor connected to a control board positioned within the hollow interior of the support column or a hollow interior of the lamp top portion of the reading lamp, wherein the control board is configured to adjust one of a power setting and a luminance of a light bulb provided in the lamp top portion in response to a sensor signal.

19. The method of claim 18, wherein the step of triggering the sensor comprises triggering a touch sensor.

* * * * *